United States Patent [19]

Cote

[11] 4,195,444

[45] Apr. 1, 1980

[54] WINDOW PANE LOCKING DEVICE FOR LOUVERED WINDOW STRUCTURES

[76] Inventor: Rolland R. Cote, 10121 Tabor, Los Angeles, Calif. 90034

[21] Appl. No.: 925,328

[22] Filed: Jul. 17, 1978

[51] Int. Cl.[2] ..... E06B 7/08

[52] U.S. Cl. ..... 49/403; 24/274 R

[58] Field of Search ..... 49/403, 371; 24/274 R, 24/274 P, 274 WB, 280, 279

[56] References Cited

U.S. PATENT DOCUMENTS

| | | | |
|---|---|---|---|
| 3,253,625 | 5/1966 | Oestereicher | 85/45 X |
| 3,769,665 | 11/1973 | McKown, Jr. | 24/274 R |
| 3,903,649 | 9/1975 | Dalia | 49/403 |
| 3,924,308 | 12/1975 | Duprez | 24/274 R |

*Primary Examiner*—Philip C. Kannan

*Attorney, Agent, or Firm*—Romney, Schaap, Golant, Disner & Ashen

[57] ABSTRACT

An apparatus and method for clamping louvered window panes in the window frame sections of a louvered window structure. The louvered window structure usually includes a plurality of pivotably movable pane supporting elements which have elongate slots to receive the panes. The apparatus comprises a clamping device in the nature of a band having a pair of overlapping terminal portions, which form an envelope section and this band is capable of being disposed over a portion of each window pane supporting element and a portion of the pane which extends beyond the slot formed in the pane supporting element. An individual clamping device is located at each of the opposite ends of each or certain of the window panes. The clamping device includes a locking mechanism which is capable of causing locking engagement of the two terminal portions of the band, such that the clamping device can be clamped about the window frame section and the pane to lockably hold the pane in the window frame structure. In the preferred aspect, the locking mechanism comprises a worm having a screw head which is engageable to be turned only in the locking direction. In this way, the louvered window structure is protected against unauthorized removal of the various louvered window panes.

10 Claims, 9 Drawing Figures

WINDOW PANE LOCKING DEVICE FOR LOUVERED WINDOW STRUCTURES

BACKGROUND OF THE INVENTION

1. Field of the Invention

This invention relates in general to certain new and useful improvements in apparatus and method for preventing unauthorized removal of louvered window panes from louvered window frame structures, and, more particularly, to apparatus and method of the type stated which is capable of clamping louvered window panes into slots forming part of the window frame structure, in such manner that they cannot be unauthorizedly removed therefrom.

2. Brief Description of the Prior Art

In recent years, due to the high incident rates of theft and burglary, people have become much more security conscious in finding ways to prevent unauthorized entry into building structures such as dwelling structures, business structures and the like. In many building structures, louvered windows are often employed. The exact details of construction of the louvered window structures may vary depending on the type used, although all louvered window structures have common elements of construction and operation.

Each of these louvered windows include a pair of spaced apart generally vertically extending frame sections located in a window opening. Each frame section includes a plurality of vertically spaced apart pivotably movable window pane retaining elements or brackets and each of which is provided with a slot to retain an individual louvered window pane. The window retaining brackets are operable by some mechanism, usually a manually operable crank to shift the various louvered window panes from a closed position where they have terminal portions relatively overlying the next adjacent window pane to an open position where the various louvered window panes lie in planes which are generally parallel to each other. Louvered window structures of this type are more fully illustrated and described in U.S. Pat. No. 1,482,996 to T. A. Jenkins.

One of the primary problems with these louvered window structures is that they provide little or no protection against unauthorized entry into the building. The average thief or burglar with an intent to burglarize will oftentimes attempt to select a building having the louvered window-type structure, inasmuch as the people inclined to these illegal activities are generally aware that the louvered window panes can be removed in a relatively short period of time. In this way, by quickly removing the window panes, the thief or burglar can oftentimes gain access into the interior of the building without being noticed. Moreover, there is little noise or obvious intrusion in removing louvered window panes compared to jarring or breaking a conventional window or door.

Heretofore, there has been no effective mechanism for preventing the unauthorized removal of louvered window panes from louvered window frame structures.

The prior art has also known of various forms of adjustable clamps, as for example, adjustable clamps of the type taught in U.S. Pat. No. 1,031,898 to E. E. Woodworth and which clamps are used as curtain fixtures. Adjustable clamps of similar constructions have been taught in U.S. Pat. No. 1,760,346 to F. M. Correa, used as bedding clamps, and in U.S. Pat. No. 779,453 to O. C. White. Similar clamps have been used as adjustable supports for lamps. A similar construction has also been taught in U.S. Pat. No. 2,901,203 to C. L. Harrison, for use as a clapboard support.

The prior art has also recognized the existence of tamperproof fastening screws, as for example, as taught in U.S. Pat. No. 3,673,912 to G. E. Herr. However, there has been no prior art construction which effectively prevents unauthorized removal of louvered window panes from window pane structures of the type described and claimed herein.

OBJECTS OF THE INVENTION

It is, therefore, the primary object of the present invention to provide a clamping device for louvered window structures which is capable of retentively and non-removably retaining louvered window panes within louvered window structures.

It is another object of the present invention to provide a clamping device of the type stated which is capable of being adjustable to conform to the general size and general shape of the window pane retaining brackets forming part of the louvered window structure and the window panes retained thereby.

It is a further object of the present invention to provide a clamping device of the type stated which is relatively easy to use and install and which is highly reliable in its operation.

It is also an object of the present invention to provide a clamping system which effectively reduces the possibility of theft or burglary in buildings having louvered window structures by preventing unauthorized removal of louvered window panes from the frame portions of the louvered window structure.

It is an additional object of the present invention to provide a clamping system of the type stated which utilizes a plurality of metal band containing devices for retaining each of the opposite ends of the louvered window panes within the frame sections of the louvered window structure.

It is another salient object of the present invention to provide a clamping system of the type stated which can be manufactured at a relatively low unit cost, but which is highly durable in its construction.

It is yet another object of the present invention to provide a method of preventing unauthorized removal of louvered window panes from the frame sections in louvered window structures.

With the above and other objects in view, my invention resides in the novel features of form, construction, arrangement, and combination of parts presently described and pointed out in the claims.

SUMMARY OF THE DISCLOSURE

A clamping system for use with louvered window structures to prevent unauthorized removal of louvered window panes from the frame sections of louvered window structures. The normal louvered window structure includes a pair of spaced apart frame sections which are securely fitted within a window opening. Each of the frame sections include pivotably movable pane supporting members often referred to as the louvered window brackets forming a part thereof. These brackets are constructed so that each is provided with an elongate slot for receiving the ends of the louvered window panes.

The pane receiving brackets and the panes retained therein are capable of being shifted, generally by a manually operable crank, from a closed position, where terminal portions of one window pane overlaps the terminal portion of the next adjacent window pane, to an open position, where the panes generally lie in planes which are generally parallel to each other. The actual construction and operation of the louvered window structure is conventional. However, it should be noted that the pane supporting brackets are oftentimes defined herein as part of the louvered window frame structure.

An individual clamping device is used at each of the ends of the window panes for retaining the window panes within the frame sections of the louvered window structures. In this case, the clamping device includes a band or strap, preferably of metal, having a pair of overlapping terminal portions. The terminal portions can be bent relative to each other to form a loop or envelope section, which is thereby capable of being disposed over the window pane retaining brackets and engaging the same and also to extend over and engage a portion of the pane extending beyond the slots in the pane retaining bracket.

Each clamping device includes a locking mechanism in the form of a first locking means on one of the terminal portions and a second locking means on the other of the terminal portions. In this way, the locking mechanism is capable of locking the terminal portions together in order to hold the panes within the elongate slots of the pane supporting brackets.

In a preferred aspect of the invention, the locking means comprises a plurality of openings in one of the terminal portions and a worm member in the other of the terminal portions and which worm member is operated by a screw. The screw is preferably of the type which is tamper-proof, so that it can be turned in only one direction, i.e., but not in the other direction. In this case, the screw is designed to turn in the locking direction so that the clamping devices will thereupon nonremovably lock the window panes into the frame structure.

The band which forms the envelope to engage the frame sections and the louvered window panes comprises a first relatively flap strip which is relatively flat for the greater portion of its length. In addition, a pair of second strips spaced apart from and generally parallel to the first strip are secured to the ends of the first strip through arcuate strip portions. These second strips form the terminal portions which overlap. The first strip and one of the second strips each include offset step portions to accommodate the next adjacent pane of louvered window structure when these panes are located in the closed position. The offset step portions may also be employed in order to permit snug-fitting engagement of the clamping devices about the window panes and the frame sections of the louvered window structure. Thus, depending upon the particular type of louvered window frame construction, the various offset portions may or may not be employed and may be located in different areas. However, there are generally two standard forms of louvered window frame structures and, hence, at least two standard types of devices may be provided in accordance with the present invention.

The clamping devices of the present invention have been found to be highly effective in preventing unauthorized removal of louvered window panes from the louvered window structure, and thereby to be effective for reducing burglary and theft. In this respect, it should be understood that one can almost always circumvent an antitheft device. Thus, while the devices of the present invention may not eliminate all thefts or burglaries through louvered windows, they are effective in preventing unauthorized removal of louvered window panes in the sense that they will impede a burglar and have significantly reduced incidence of theft and burglary.

This invention possesses many other advantages, and has other purposes which may be made more clearly apparent from a consideration of forms in which it may be embodied. These forms are shown in the drawings accompanying and forming part of the present specification. They will now be described in detail, for the purpose of illustrating the general principles of the invention; but it is to be understood that such detailed descriptions are not to be taken in a limiting sense.

BRIEF DESCRIPTION OF THE DRAWINGS

Figure 1:
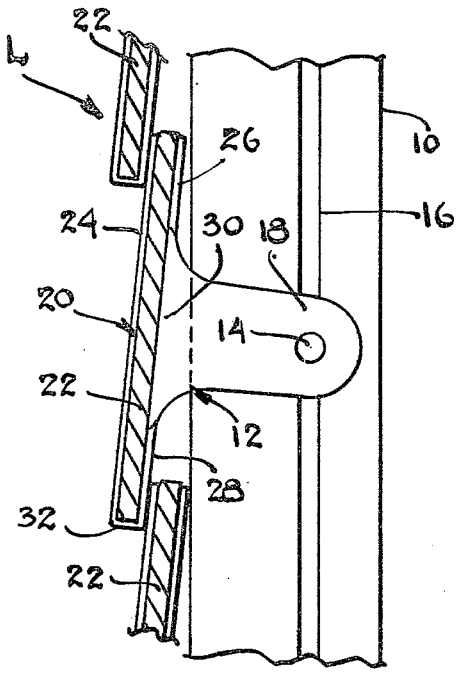
PRIOR ART FIG. 1
Figure 3:
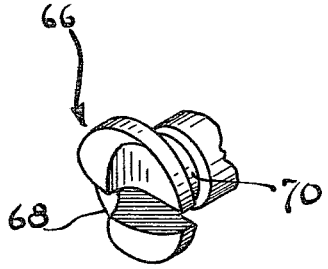
Figure 2:
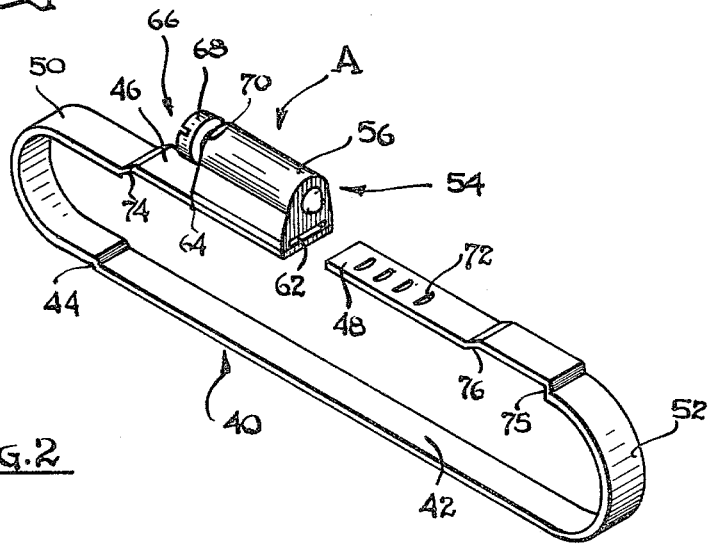
Figure 4:
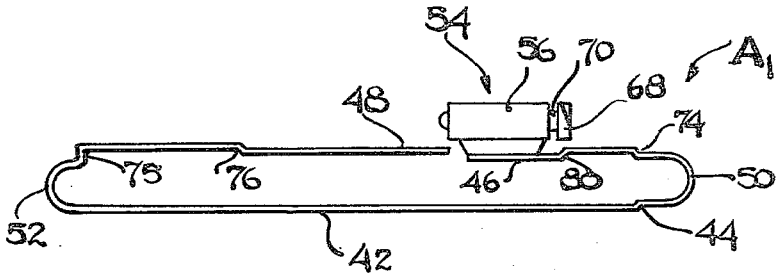
Figure 5:
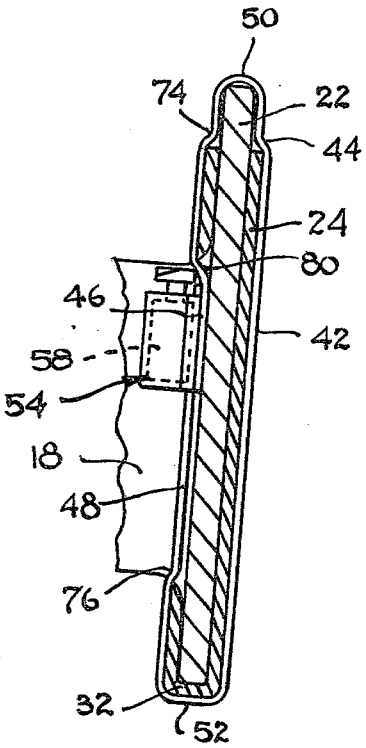
Figure 7:
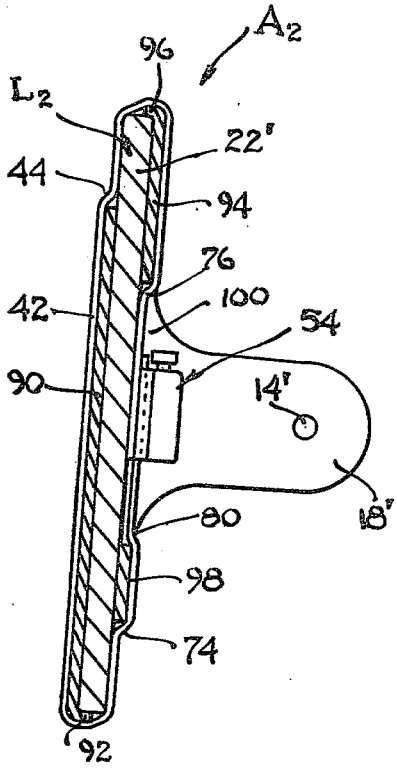
Figure 6:
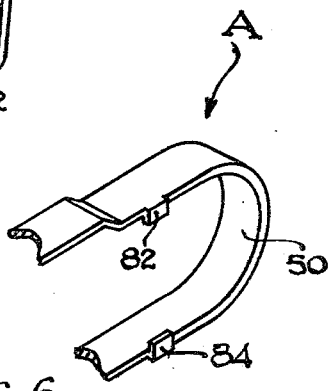
Figure 9:
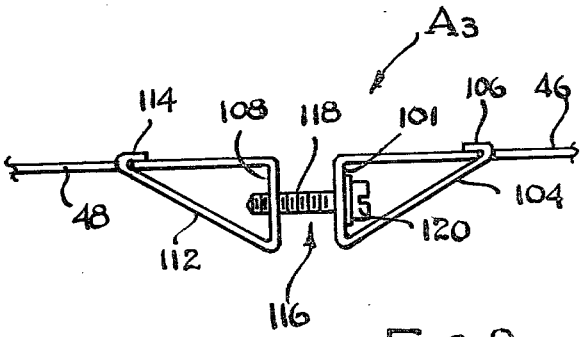
Figure 8:
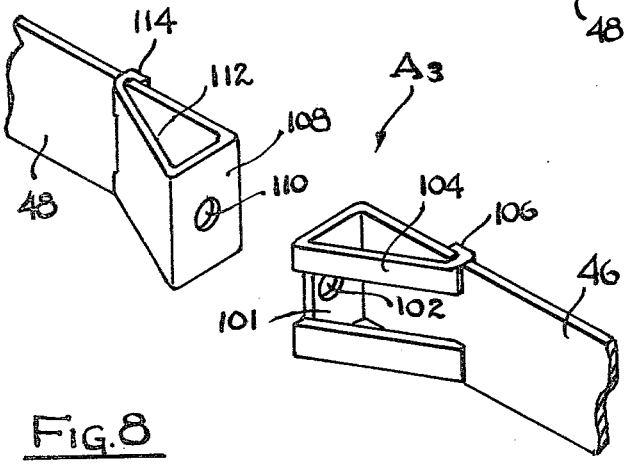

Having thus described the invention in general terms, reference will now be made to the accompanying drawings in which:

FIG. 1 is a side elevational view, partly broken away and in section, showing a conventional louvered window structure with which the clamping device of the present invention may be employed;

FIG. 2 is a perspective view of a typical clamping device of the present invention;

FIG. 3 is a perspective view of a locking screw used with the clamping device of FIG. 2;

FIG. 4 is a side elevational view showing the form of clamping device of the present invention for use with the louvered window structure of FIG. 1;

FIG. 5 is a vertical sectional view showing the clamping device about the louvered window structure and in engagement therewith;

FIG. 6 is a perspective view partially broken away and showing a modified form of clamping device of the present invention;

FIG. 7 is a vertical sectional view of the clamping device of the present invention used with a modified form of louvered window structure;

FIG. 8 is a fragmentary exploded perspective view showing another modified form of clamping device of the present invention; and FIG. 9 is a side elevational view, partially in section, and showing the use of the clamping device of FIG. 8.

DETAILED DESCRIPTION OF A PREFERRED EMBODIMENT

Referring now in more detail and by reference characters to the drawings, which illustrate a preferred embodiment of the present invention, A designates a clamping device constructed in accordance with the present invention. The clamping device A is used with louvered window structures L of the type illustrated in FIG. 1 of the drawings. In order to more fully appreciate the understanding of the clamping device A of the present invention, a brief description of the construction and operation of these conventional louvered window structures is provided.

In general, the louvered window structures comprise a pair of spaced apart frame sections 10 which fit within the oppositely disposed vertical walls forming part of a window opening. Each of these frame sections 10 are secured to the wall portion forming the window opening and generally are formed of metal strip sections. Each of the frame sections 10 comprise a plurality of vertically disposed, spaced apart, louvered window pane support members, often referred to as pane retaining brackets. These brackets 12 are usually secured to the frame sections 10 through pivot pins 14, the latter extending through elongate openings 16 leading to an operating mechanism (not shown). Each of the brackets 12 are comprised of a flat plate 18 opening into a somewhat upwardly opening U-shaped channel section 20 for retaining a conventional louvered window pane 22.

The channel section 20 is formed by a flat wall section 24 along with opposed flange sections 26 and 28 which are connected to the flat plate 18. The flange sections 26 and 28 are separated from each other by an opened section 30. Moreover, the flange section 28 may be integrally connected to the flat wall section 24 through an arcuate end section 32.

The louvered window panes 22 are preferably made of a glass or plastic material of a transparent nature. However, these window panes are not necessarily glass or plastic and could be formed of any material. Moreover, these panes are not necessarily transparent in construction.

The various pivotal support members or brackets 12 can be shifted from the closed position where portions of the vertically disposed support structure 12 overlap each other to an open position. In the open position, the support members 12 would be rotated to a position where the U-shaped channel 20 of one bracket 18 lies generally parallel to the U-shaped channel 20 of the next adjacent pane support structure or bracket 18.

One embodiment of the clamping device A of the present invention is more fully illustrated in FIGS. 2 and 3 of the drawings. In this case, the clamping device A generally comprises a band 40 having a strip 42, which, in this case, is referred to and illustrated as a lower strip section 42 and may be referred to as a "first" strip section. The lower strip section 42 may include one or more offset step portions, as for example, an offset step portion 44 integrally formed therein, in the manner as illustrated in FIG. 2 of the drawings. The lower strip section 42 integrally merges into upper strip sections 46 and 48 through arcuate end sections 50 and 52, respectively and which upper strip sections may be referred to as "second" strip sections. At least end portions of the upper strip sections 46 and 48 function as terminal portions and may be generally parallel to the first strip section 42.

The upper terminal portion 46 is provided on the end thereof with a first locking means 54 in the form of a housing 56 containing a rotatable worm 58 which extends into an elongate slot 62 in the terminal portion 46 at the lower end of the housing 56. The elongate opening or slot 62 is formed by a strap 64 extending transversely around the terminal portion 46. The worm 58 actually forms part of a worm screw 66 having a screw head 68 on the end of a screw shaft 70 such that the worm 58 may be formed as threads on the shaft 70. Otherwise, an individual worm could be employed with a shaft extending therefrom.

The screw head 68 preferably is of a type which is rotatable in only one direction, namely, the locking direction, much in the manner as illustrated and described in U.S. Pat. No. 3,673,912. However, any means for rotating the worm 58 may be employed in accordance with the present invention.

The terminal section 48 is provided with a second locking means in the form of a plurality of spaced apart apertures 72. In this case, the apertures 72 are formed by a generally flat edge and an opposed, somewhat arcuate edge, in the manner as illustrated in FIG. 2 of the drawings. However, the size and shape of the apertures is made to cooperate with the first locking means.

The clamping device A as illustrated in FIG. 2 has been enlarged in the vertical dimension compared to FIG. 3 for purposes of clarity. Further, the clamping device A as illustrated in FIGS. 2 and 3 of the drawings is more of a generalized form of clamping device and is useful for many forms of louvered window structures. However, it is possible to include various step portions in the clamping device A in order to account for the specific variations and designs of the window frame structures. Thus, in the embodiment as illustrated, the clamping device A may include an offset step 74 in the terminal portion 46 and a similar offset-step 75 in the terminal portion 48. In this case, the offset step 44 and the offset step 74 immediately thereabove, as well as the offset step 75, function to increase a portion of the overall vertical dimension (reference being made to FIG. 2) of the envelope which will ultimately enclose the frame section and the window pane.

The terminal portion 48 may also include an offset step 76, in the manner as illustrated in FIGS. 2 and 3. In this regard, the steps 44, 74 and 75 increase the overall vertical dimension (again reference being made to FIG. 2), while the step 76 decreases the vertical dimension. The steps 44, 74 and 75 are employed if the louvered window frame sections do not extent to the opposite edges of the panes. Otherwise, if the frame sections do extend fully around the opposite edges of the panes, the steps 44, 74 and 75, or some of them, could be eliminated.

Again, the clamping device A could employ offset steps which expand or reduce the size between the terminal portions and the flat strip 42 in order to account for the variations in design construction of the window frame sections and the window frames. Moreover, it can be observed that the step portions are generally angulated at about 45°, although the angle can vary in order to conform to these variations in design construction.

FIG. 4 more fully illustrates the form of clamping device designated as $A_1$ which would be used with the louvered window structure L of FIG. 1 of the drawings. In this case, the clamping device $A_1$ is similar in construction to the generalized form of clamping device A, except that it includes an additional offset step 80 formed within the first terminal section 46. FIG. 5 more fully illustrates the use of the clamping device $A_1$ about the louvered window structure L. In this case, it can be observed that the offset steps 44 and 74 are designed so that the end portion 50 is capable of engaging the extended portion of the window pane 22. Thereafter, the lower strip section 42 will engage the flat wall section 24 and the arcuate end sections 52 will engage arcuate end section 32 of the frame section, in the manner as illustrated in FIG. 5. It can be observed that the two terminal portions 46 and 48 include the offset steps 76 and 80 in order to account for the open section 30 between the two retaining flanges 26 and 28 in the frame section. In this way, the clamping device $A_1$ is capable of conforming to the design variations in the louvered window structure. The clamping device also prevents any possibility of inserting a screw driver or similar implement between the clamping device and the window pane or between the clamping device and window frame structure in order to pry the clamp from the frame section.

The band 40 is preferably formed of a metal material, as for example, a thin gauge aluminum, although other forms of metal, such as magnesium, steel, or the like, may be employed. In addition, the metal should be somewhat flexible so as to be bent to conform to the desired shape of the actual louvered window frame structure. However, the bending is merely that of a minor nature, merely to conform to the actual size of the window frame structure. Generally, the shape and overall size of most louvered window frame structures is standard and, hence, the clamping device A can be made to a standard size. The bending which might be required is merely that to conform to the nondimensional errors that might result by machine operations in the producing of the window frame structures and the like. However, the general outer appearance of the clamping device A will not materially change.

When using the clamping device A of the present invention, the terminal end 48 is free of the locking mechanism 54. Thus, the band 40 can be disposed about the U-shaped channel 20 and the upper extended end of the louvered window pane 22. In this way, one of the arcuate ends 52 can engage the lower end of the channel 20 and the other arcuate end 50 can engage the upper end of the window pane 22. The terminal portion 48 is then inserted into the elongate slot 62.

By rotating the screw head 68, the worm 58 will engage the successive apertures 72, thereby causing the movement of the terminal portion 48 through the slot 62 and thereby also causing a shorter overall peripheral dimension. As the screw head 68 is continually turned, the band 40 will achieve the approximate size of the window pane and the frame structure so as to completely encapsulate an end of the window pane within the slot of the frame section. Again, and as indicated above, a pair of clamping devices would be used at each of the opposite ends of the pane and the associated structural frame sections.

It can be observed that the offset portions 44 and 74 permit the clamping devices to be used so that the steps accommodate the edge of the next adjacent window pane and frame structure when in the closed position. It can be observed by reference to FIG. 1 that in absence of the steps 44 and 74, the louvered window segments could not be fully shifted to the closed position. In addition, in absence of the steps 44 and 74, the clamping device $A_1$ would not necessarily conform to the exact structure of the window pane and the louvered window frame section.

In accordance with the above construction, the clamping device $A_1$ will closely engage the extended portion of the window pane 22 and, in addition, alters its size so as to conform to and closely engage both the flange sections 26 and 28, as well as the flat wall section 24 of the window frame section. In this way, it is virtually impossible to insert a screwdriver or other prying implement under the clamp in order to force the same from the window frame section. The steps 76 and 80 also allow for the terminal portions 46 and 48 to extend slightly inwardly in order to engage portions of the window pane 22 which were not engaged by the frame section. This construction permits very close tolerance between the clamping device A and the window frame structure including the window pane therein.

FIG. 6 illustrates a slightly modified form of clamping device A of the present invention and which includes a pair of inwardly struck retaining tabs 82 and 84. In this case, the retaining tab 82 is located on the one edge of the terminal portion 46 and another tab 48 is located within the flat strip section 42. In like manner, similar retainer tabs will be located within the same edge of the terminal section 48 and a corresponding portion of the flat strip 42 therebeneath. These retaining tabs 82 and 84 are designed and located to engage the outermost edge of the brackets 12 in order to prevent any unauthorized attempt to shift the clamping devices longitudinally towards the center of the window pane in order to obviate the clamping engagement. It can be observed that no similar retaining tabs are required on the opposite edges of the band 40. Thus, by the provision of one or more retaining tabs 82 and 84 on the outermost edges of the bands 40, it is virtually impossible to either pry the band loose from or forcibly shift the band along the frame section or the window pane section in order to permit removal of the window pane from the frame section.

FIG. 7 illustrates a slightly modified form of clamping device $A_2$ used with a slightly modified form of louvered window structure $L_2$. In this case, the louvered window structure $L_2$ includes a plate 18' which is pivotally secured to a frame section (not shown) through a pivot pin 14'. The plate 18' integrally merges into a first elongate wall section 90 extending for most of the lateral distance of one transverse edge of a window pane 22'. The wall section 90 includes a lower laterally struck tab 92 which is capable of engaging and retaining a longitudinal margin of the window pane 22'. In addition, the flat plate 18' includes a first flange 94 spaced from the flat wall section 90 and engaging one edge of the opposite surface of the window pane 22'. The flange 94 similarly includes a laterally struck tab 96 capable of engaging the other longitudinal margin of the window pane 22', in the manner as illustrated in FIG. 7 of the drawings. Finally, the flat plate 18' integrally includes a second window pane engaging flange 98 which also engages the same flat surface as the flange 94. It can also be observed that an open space 100 exists between the window pane engaging flanges 94 and 98.

This form of louvered window structure $L_2$ requires a slightly different clamping device construction which gives rise to the clamping device $A_2$. In this case, the clamping device $A_2$ includes the flat strip 42 having the offset step 44 therein. The offset step 44 is designed to engage the end of the window pane 22' which is not engaged by the flat wall section 90. The first terminal portion 46 similarly includes the offset step 74 which also engages the end of the window pane surface which is not engaged by the retaining flange 98. In like manner, the clamping device $A_2$ also includes the offset steps 76 and 80 in order to engage the area of the window pane not engaged by the retaining flanges 94 and 98. In this way, it can be observed that the clamping device $A_2$ is very similar to the clamping device $A_1$ except that the offset step 44 is diagonally opposed to the step 74.

FIGS. 8 and 9 illustrate another embodiment of clamping device $A_3$ forming part of the present invention. In this case, the clamping device $A_3$ could adopt any of the forms of the clamping devices previously described and is similar to the clamping device A except that it employs a slightly different locking means. The locking means used in the clamping device $A_3$ comprises a laterally bent plate 101 on the first terminal section 46 and which is provided with a bolt receiving aperture 102. Moreover, the flat plate 101 is reinforced by spaced apart diagonally extending legs 104 having tabs 106 engaged within grooves formed within the terminal section 46. In like manner, the terminal portion 48 is similarly provided with a laterally struck flat plate 108 having a bolt receiving aperture 110 in alignment with the bolt receiving aperture 102. Moreover, the plate 108 is similarly reinforced by diagonally extending arms 112 having tabs 114 fitted within slots formed in the terminal portion 48. Thus, it can be observed that the bolt receiving apertures 102 and 110 are capable of receiving a bolt 116 having a shank 118 extending between the two flat plates 101 and 108 and which is also provided with a bolt head 120. In this case, the bolt head 120 will adopt that form of construction as illustrated in FIG. 3 so as to be relatively unremovable therefrom.

Thus, there has been illustrated and described a unique and novel clamping device for preventing unauthorized removal of louvered window panes from louvered window structures, and which, therefore, fulfills all of the objects and advantages sought therefor. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention which is limited only by the following claims.

Having thus described my invention, what I desire to claim and secure by Letters Patent is:

1. A louvered window structure in which the window panes of the structure cannot be generally unauthorizedly removed therefrom, said structure comprising:

(a) a window frame section having a slot formed therein, (b) a louvered window pane having an end thereof disposed within said slot, (c) a clamping device comprising;

(i) a first strip section which is relatively flat across a greater portion of its length, (ii) a pair of opposed second strip sections which are relatively flat across greater portions of their length, said second strip sections capable of being disposed so that they are generally parallel to said first strip section across said greater portions of their lengths, (iii) an arcuate end section connecting one of the ends of said first strip section and one of the ends of one of said second strip sections, and another arcuate end section connecting the other of the ends of the first strip section and one end of the other of the second strip sections thereby forming an envelope section disposed over said frame section and engaging a portion or said frame section and a portion of said pane to thereby hold said pane in said slot, and (iv) a first terminal portion on one of said second strip sections, (v) a second terminal portion on the other of said second strip sections and capable of being engageable with said first mentioned terminal portion, (vi) a pair of step portions in at least one of said strip sections to accommodate a next adjacent pane in the louvered window structure when said panes are located in a certain position, or to snuggly engage said frame section and said pane, (d) said clamping device comprising first looking means on said first terminal portion and second cooperating locking means on said second terminal portion for locking said terminal portions together to thereby lockably hold said pane in the slot of said frame section, said first locking means and second cooperating locking means being non-releasably lockable and operating in such manner that they provide for adjustment of the size of said envelope section.

2. The louvered window structure of claim 1 further characterized in that said louvered window structure comprises a plurality of frame sections with each frame section having a louvered window pane retained thereby, said band has a pair of step portions to accommodate a next adjacent pane in the next adjacent frame section of the louvered window structure when said panes are located in a certain position, or to snugly engage said first named frame section and said first named pane.

3. The louvered window structure of claim 1 further characterized in that said first locking means comprises a worm means on one of said terminal portions and said second locking means comprises a plurality of slots in the other of said terminal portions.

4. The louvered window structure of claim 3 further characterized in that the worm means comprises a worm screw with a head engageable to be turned only in the locking direction.

5. A clamping device for a louvered window structure comprised of a frame section having a first relatively flat member and a second relatively flat member forming an elongate pane receiving slot therebetween and with a louvered window pane disposed in said slot, said clamping device comprising:

(a) a metal band comprised of:

(i) a first strip section which is relatively flat across a greater portion of its length, (ii) a pair of opposed second strip sections which are relatively flat across greater portions of their length, said second strip sections capable of being disposed so that they are generally parallel to said first strip section across said greater portions of their lengths, (iii) an arcuate end section connecting one of the ends of said first strip section and one of the ends of one of said second strip sections, and another arcuate end section connecting the other of the ends of the first strip section and one end of the other of the second strip sections thereby forming an envelope section disposed over said frame section and engaging a portion of said frame section and a portion of said pane to thereby hold said pane in said slot, and (iv) a first terminal portion on one of said second sections, (v) a second terminal portion on the other of said second strip sections and capable of being engageable with said first terminal portion, (vi) a pair of step portions in said band to accommodate a next adjacent pane in the louvered window structure when said panes are located in a certain position, or to snuggly engage said frame section and said pane, (b) first locking means on said first terminal portion and second cooperating locking means on said second terminal portion for locking said terminal portions together to thereby lockably hold said pane in the slot of said frame section, said first locking means and second cooperating locking means being nonreleasably lockable and operating in such manner that they provide for adjustment of the size of said envelope section.

6. The clamping device of claim 5 further characterized in that said band comprises at least one additional step portion to accommodate for thickness variation between said frame section and pane and thereby permit said band to snuggly engage said frame section and said pane substantially for its entire surface area facing said pane and frame section.

7. The claiming device of claim 5 further characterized in that said first locking means comprises a worm means on one of said terminal portions and said second locking means comprises a plurality of slots in the other of said terminal portions.

8. The clamping device of claim 7 further characterized in that the worm means comprises a worm screw with a head engageable to be turned only in the locking direction.

9. The clamping device of claim 5 further characterized in that said first and second terminal portions each comprises a flat plate on the ends of and struck generally perpendicularly with respect to said second strip sections and said first and second plates capable of being engageable with each other, leg means extending between said plates and the strip section on which each said plate is located, and means associated with each said plate for locking said plates together.

10. The clamping device of claim 9 further characterized in that the means for locking comprises apertures in each of said plates for receiving a locking member to lock said plates together.

* * * * *